United States Patent [19]

Strobel, Jr.

[11] 3,934,869

[45] Jan. 27, 1976

[54] SHEET SEPARATING AND FEEDING APPARATUS

[75] Inventor: Erwin J. Strobel, Jr., Rochester, N.Y.

[73] Assignee: Xerox Corporation, Stamford, Conn.

[22] Filed: Dec. 20, 1973

[21] Appl. No.: 426,976

[52] U.S. Cl. ..... 271/35; 271/166

[51] Int. Cl.[2] ..... B65H 3/04

[58] Field of Search ..... 271/35, 34, 110, 111, 134, 271/118, 166

[56] References Cited

UNITED STATES PATENTS

| | | | |
|---|---|---|---|
| 2,806,696 | 9/1957 | Bishop | 271/166 X |
| 2,852,255 | 9/1958 | Fischer | 271/35 X |
| 3,193,282 | 7/1965 | Stewart | 271/35 X |
| 3,231,263 | 1/1966 | MacNeill et al. | 271/3 |
| 3,252,702 | 5/1966 | Halbert | 271/94 |
| 3,385,593 | 5/1968 | Snellman | 271/166 X |
| 3,575,410 | 4/1971 | Suzuki | 271/111 |
| 3,596,901 | 8/1971 | Rehm et al. | 271/35 |

OTHER PUBLICATIONS

Maliwacki, IBM Technical Disclosure Bulletin, "Document Picker Cam," Vol. 11, No. 11, 4–1969.

*Primary Examiner*—Evon C. Blunk
*Assistant Examiner*—Bruce H. Stoner, Jr.

[57] ABSTRACT

A sheet feeding device adapted to separate a single sheet from a stack of sheets and forward the separated sheet away from the stack for subsequent processing. The apparatus includes a feed belt mounted for movement on at least two stationary rolls and a movable roll, the section of the belt between the two stationary rolls being adapted for frictional engagement with retard means forming a sheet feed nip therebetween. A sheet sensor adjacent the retard means and the feed belt is employed to displace the movable roll and the portion of the feed belt mounted thereon into engagement with the sheet stack to increase the feed belt "foot print" when the absence of a sheet is sensed during a feed cycle to increase the feed force on the sheet. The feed mechanism is adapted to operate on the bottom sheet of a sheet stack which is subjected to a flow of pressurized air against the bottom sheet to reduce friction between the bottom sheet and the stack tray and between the bottom sheet and the sheet immediately thereabove.

8 Claims, 3 Drawing Figures

SHEET SEPARATING AND FEEDING APPARATUS

BACKGROUND OF THE INVENTION

In modern, high speed sheet processing machines such as printers, sorters, collators, reproduction machines, etc. a sheet misfeed or multi-fed sheets can seriously impair the operation of the machine. Numerous devices of the type disclosed in U.S. Pat. No. 3,768,803 have been employed to minimize the possibility of misfeeds and multi-feeds.

To provide a constant normal force between the sheet being fed and the feed mechanism, it is common practice to employ a sheet elevator tray assembly having sheets stacked thereon, the feed mechanism being disposed above the stack for feeding the top sheet from the stack. As sheets are fed from the stack, the elevator is continuously shifted in an upward direction to maintain the top sheet in the stack adjacent the feed mechanism. This type of feeder is ordinarily used when a varying quantity of sheets may be loaded into the sheet tray to overcome problems encountered in bottom feed devices whereby an excessive weight or constantly varying weight of sheets may be encountered which interferes with removal of the sheet from the bottom of the stack. While the bottom feed device is more convenient since the stack may be replenished without stopping machine operation and the necessity of an elevator type sheet tray is obviated, the poor paper feeding capabilities of bottom feed devices has prevented common acceptance thereof.

SUMMARY OF THE INVENTION

The subject invention relates to a bottom sheet feed device employing pressurized air to reduce friction between the bottom sheet and the sheet stack tray and minimize friction between the bottom sheet and the sheet immediately adjacent thereto. To prevent misfeeds, a tri-roller feed belt is employed having two stationary rolls and a movable roll, the stationary roll disposed beneath the edge of the sheet stack serving to support the feed belt against the lower sheet for feeding the sheet from the stack, the movable roller being disposed adjacent the aforesaid stationary roller for movement into engagement with the bottom sheet on the stack in the event that a sheet is not forwarded at the proper time under the influence of the belt section above the stationary roller. The displacement of the movable roller increases the surface area of the belt in contact with the bottom sheet of the stack to exert a greater feed force thereon. Further, since one of the primary reasons for incipient misfeeds is increased friction between the sheet being fed and the adjacent sheet which increass the possibility of dragging the adjacent sheet into the feed nip, displacement of the roller also tightens the feed belt to provide increased force against the retard means to prevent passage of sheets that may be carried along with the sheet being fed.

DESCRIPTION OF THE PREFERRED EMBODIMENT

Figure 1:
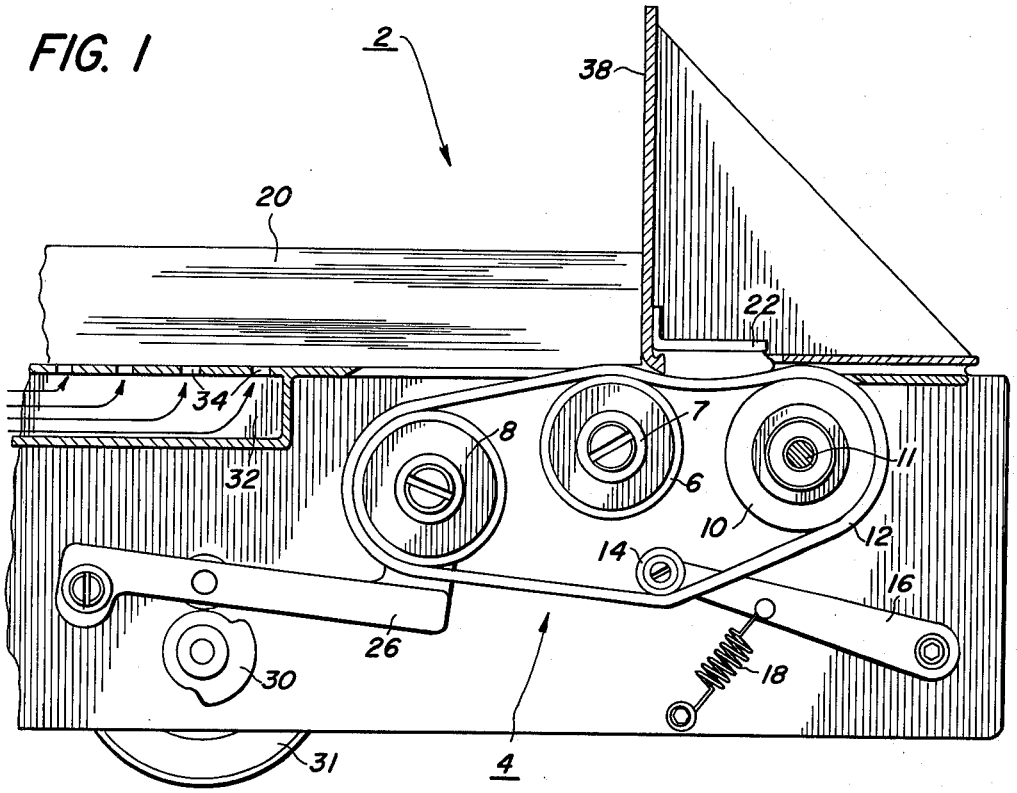
FIG. 1 is a side elevational view of the preferred embodiment of the present invention.

Referring to the drawings, the sheet feeding apparatus of the present invention includes a sheet supply tray 2 and a sheet separation apparatus 4. The sheet separation apparatus 4 is comprised of rolls 6, 8, and 10 having a belt 12 mounted thereon. The belt is formed of a suitable non-stretch high friction material such as rubber impregnated fabric for reasons to be hereinafter explained. A tension roll 14 mounted on pivot arm 16 is biased against belt 12 by a spring 18 to provide a preselected tension on belt 12 under normal operating conditions.

Rolls 6 and 10 are mounted on stationary axes 7 and 11 respectively to maintain a desired spacial relationship between the edge of the paper stack 20, an abutment type retard pad 22, and the lower surface of tray assembly 2. For a complete description of the relationship between a feed belt, an abutment type retard means and the sheets stacked on tray assembly 2, reference may be had to U.S. Pat. No. 3,768,803, commonly assigned with the present application.

Roll 10 is driven by a motor-clutch mechanism 24, the motor preferably being constantly energized, the clutch associated therewith being activated by a suitable feed signal whenever a sheet is to be fed by the sheet separation apparatus 4.

Figure 2:
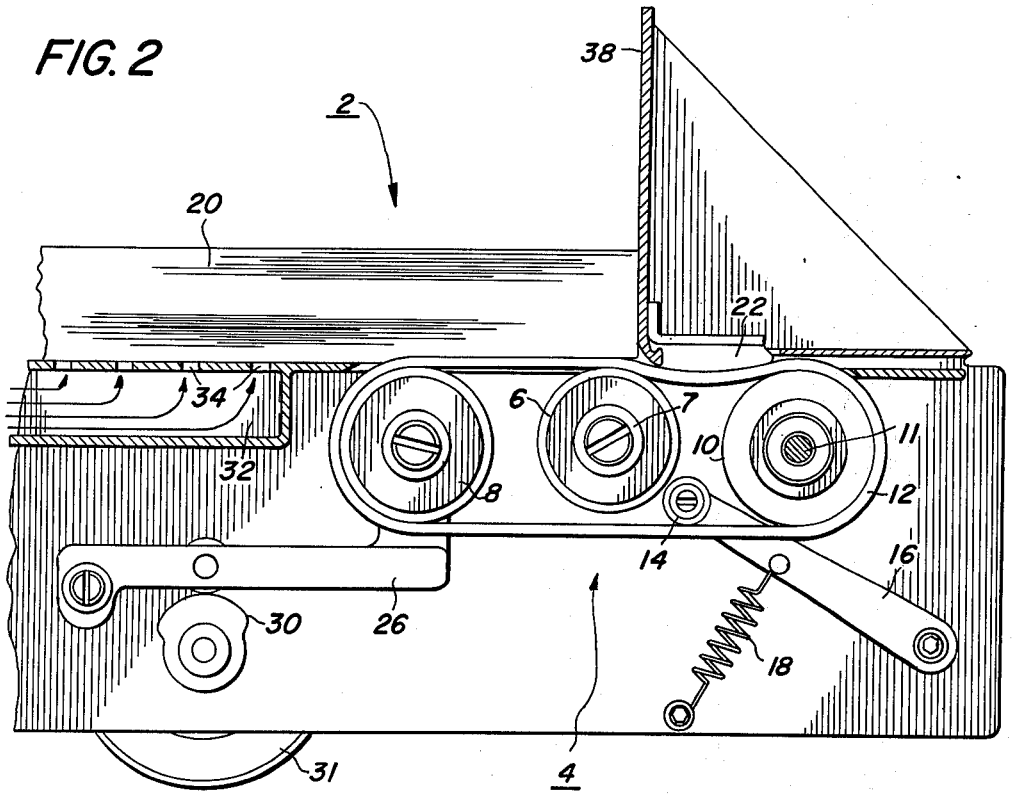
FIG. 2 is a side elevational view of the apparatus of FIG. 1 illustrating the movable roller in a position to provide increased feed force against the sheet being fed.
Figure 3:
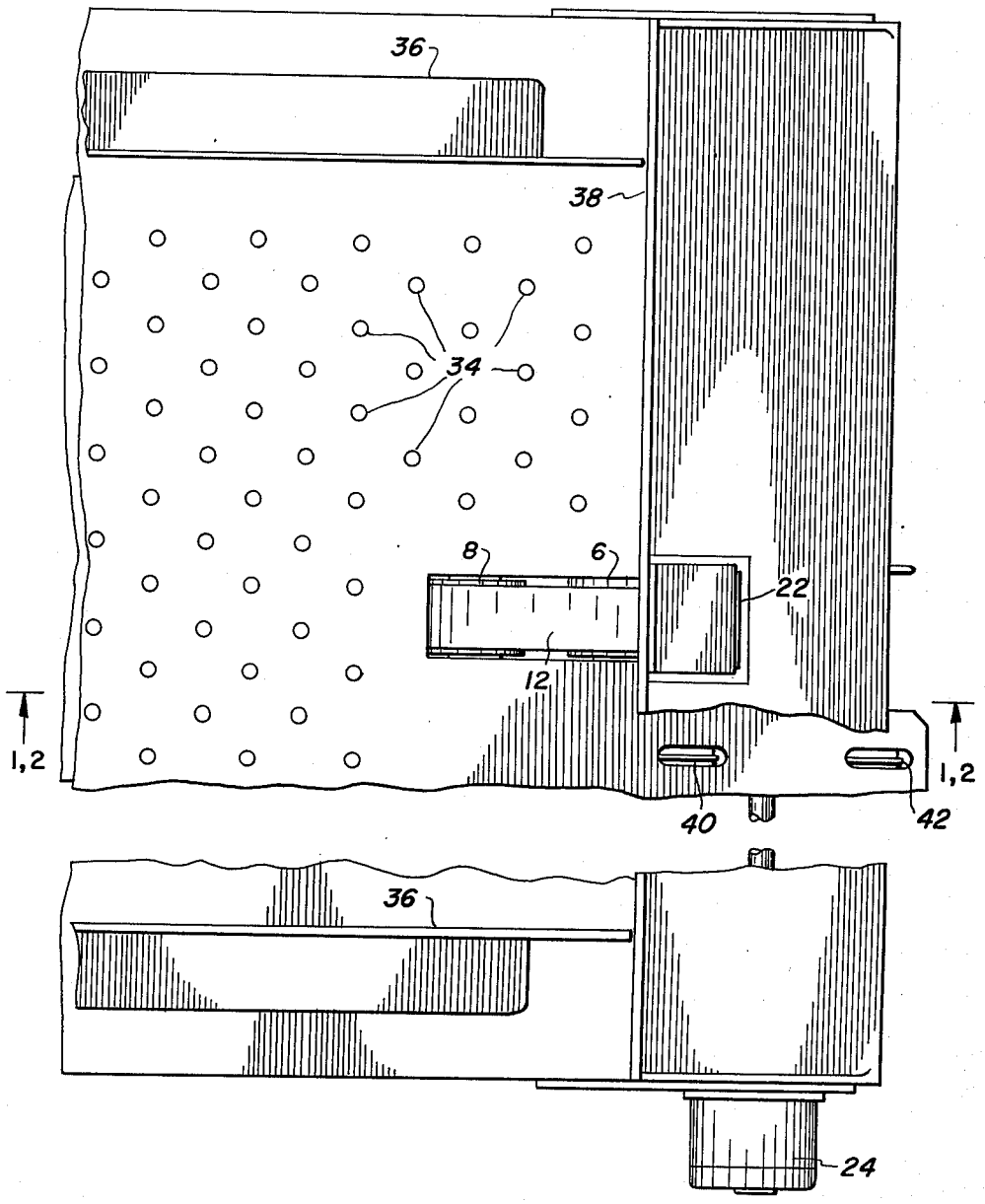
FIG. 3 is a plan view of the apparatus of FIG. 1 with the sheets removed to illustrate the perforations in the stack tray for supplying air thereto.

Roll 8 is mounted on a pivot arm 26 which is adapted for movement to the position shown in FIG. 2 by a cam 30 which is adapted for rotation by suitable means such as a clutch-motor drive 31 under extraordinary circumstances to be hereinafter described. Under ordinary circumstances, the cam is disposed as illustrated in FIG. 1, thereby allowing pivot arm 26 and roll 8 to assume the position illustrated in FIG. 1. A plenum 32, adapted to receive a pressurized fluid such as air from a suitable source (not shown) is formed beneath the bottom surface of tray assembly 2, perforations 34 being provided in tray assembly 2 for passage of the pressurized fluid therethrough. The air supplied through perforations 34 creates an air cushion between the bottom sheet of the stack and the lower surface of the tray to minimize friction therebetween and aid in the removal of the sheet from the stack by the separation apparatus 4. Further, it can be seen by reference to FIG. 3 that the tray assembly is provided with sides 36 and edge abutment plate 38. Air escaping from under the stack is caused to flow between the lowermost sheets in the stack due to the presence of the sides 36 and abutment plate 38, thereby reducing the frictional engagement between the lowermost sheet in the stack and the sheets immediately adjacent thereto. The air supplied between the lowermost sheet and the sheets thereabove along the sides of the stack is augmented by air which permeates the bottom sheet and enters the space between the bottom sheet and the sheets immediately thereabove.

By the utilization of air floatation and a separator assembly as illustrated in FIG. 1, normal sheet separation without misfeeds or multi-feeds may be easily accomplished. However, in the event that sheets stacked on tray assembly 2 have extremely high inter-sheet friction or are otherwise difficult to separate, roll 8 may be pivoted up to the position illustrated in FIG. 2 to provide increased frictional contact between the feed belt 12 and the bottom sheet in the stack for positive separation thereof. It can be seen from FIG. 2 that when roll 8 is in the raised position, the bias roller 14 does not deflect belt 12. The roller 8 and the pivot arm associated therewith are arranged to increase the tension in belt 12 to a level greater than that normally provided by the tension roll 14. This increased tension causes a greater force to be exerted on the retard pad 22 by the belt for increased retard drag on sheets which may be carried thereto along with the sheet being fed. Since the increased resistance to feed of the lowest sheet requiring raising of roll 8 is normally due to increased frictional contact between the bottom sheet and the sheet immediately thereabove, it necessarily follows that a greater retard force is necessary to prevent feeding of multiple sheets through the device. By arranging the roll 8 and its associated pivot arm such that an increased force is provided between the friction pad 22 and the belt 12, the possibility of a multi-feed under abnormal inter-sheet frictional force conditions is obviated.

A first sheet presence sensor 40 is provided on the sheet feeding device to sense the presence of a sheet between the retard pad 22 and the belt 12 and a second sheet presence sensing device 42 is located downstream from the feeding mechanism for reasons to be hereinafter explained. The sensors 40 and 42 may take any of the number of forms such as a small wire finger projecting into the feed path which would be deflected by the passage of a sheet thereover to activate a microswitch or in the alternative, the sensors may consist of phototransistor and light combinations, the light to the phototransistor being blocked upon passage of the sheet therebetween to produce a signal indicative of sheet location.

Considering the operation of the sheet feeding device under normal operating conditions, the motor-clutch combination 24 driving roll 10 would be energized in response to a suitable signal from the device employing the sheet feed mechanism. Energization of the motor-clutch will cause movement of belt 12 beneath stack 20 toward the right as illustrated in FIGS. 1 and 2 to pull the bottom sheet from the stack between the belt and the retard pad and carry the sheet to suitable sheet transport mechanism (not illustrated) downstream from the sheet feed apparatus. Sensor 42 may be located at a point whereat the sheet is contacted by subsequent sheet transporting apparatus to sense the successful feeding of a sheet thereto, passage of the sheet beneath the sensor 42 generating a suitable signal to terminate operation of the feeding apparatus 4 until a second sheet is to be fed.

In the event that a problem is encountered in feeding the bottom sheet, if sensor 40 does not sense the presence of a sheet between pad 22 and belt 12 within a predetermined time interval after the feed apparatus 4 is energized, a suitable signal may be produced by the sensor to energize motor-clutch combination 31 to rotate cam 30 through one revolution. As stated heretofore, rotation of cam 30 will cause pivot arm 26 and roll 8 mounted thereon to be provided upwardly toward the stack 20 to increase the surface area of belt 12 in contact with the bottom sheet of the stack for feeding sheets under abnormal conditions. When the fed sheet reaches sensor 42, the sheet feeding apparatus 4 will be deenergized until the next subsequent sheet feed cycle.

It can be seen from the foregoing, that the sheet feeding device provides optimal break-away force on the bottom sheet of a stack for separating the sheet from the stack under normal operating conditions and also provides means for increasing the feeding force to an above normal level where difficulties are encountered in feeding certain sheets due to numerous conditions which may be encountered in a sheet feeding apparatus such as foreign material on the bottom sheet which may provide minimal frictional engagement between the feed belt and the sheet or rough, heavy sheets which may have high frictional inter-sheet resistance to separation, extremely heavy sheet stock which would have a high inertial resistance to movement by the sheet separator etc. Thus, by providing a variable foot print feed belt to accommodate varying sheet separating resistance, and means to provide increased frictional contact between the retard pad and the feed belt under conditions wherein a high resistance to feed is encountered, the possibility of sheet misfeeds or multi-feeds is obviated.

The disclosed separator provides improved sheet feeding for both bottom feed operations as described or for feeding sheets from the top of a stack. In the event that extremely heavy or large stacks of sheets are to be encountered when the device is used as a bottom feeder, the disclosed air floatation may be employed as further insurance against misfeeds or multi-feeds, although it should be understood that the use of air floatation is not a prerequisite for the disclosed feeder under many normal sheet feed applications.

While I have described a preferred embodiment of my invention it is to be understood that the invention is not limited thereto but may be otherwise embodied within the scope of the following claims

What is claimed is:

1. An apparatus for feeding and separating individual sheets from a stack of sheets including:

a first feed roll mounted on a stationary axis adjacent the forward edge of the stack for separating sheets from the stack under normal operating conditions;

a second feed roll mounted on a second axis adjacent said first feed roll, said second axis being movable toward and away from the stack to move said second feed roll toward and away from the stack;

friction surface means associated with said first roll and said second roll, movement of said second roll toward the stack causing an increase in the friction surface area contacting the stack; and, means for automatically moving said second roll toward said stack when a non-feed condition is encountered during a sheet feed cycle.

2. An apparatus for feeding and separating individual sheets from a stack of sheets including:

an endless sheet feeding and separating belt mounted for sheet feeding engagement with the edge of the stack of sheets, said belt being rotatably mounted on a plurality of rolls, a first one of said rolls being disposed adjacent the edge of the stack to support said belt in contact with the stack, a second one of said rolls being disposed adjacent said first roll, the axis of said second roll being movable toward and away from the stack to force a greater portion of said belt into contact with the stack when said second roll is moved toward the stack, a stationary retard pad mounted opposite said belt between said first roll and a third one of said rolls, said third roll being disposed on the side of said first roll opposite said second roll, said stationary retard pad being located to depress said belt between said first and third rolls, said belt being formed of a substantially non-stretch material, movement of said second roll toward said stack causing increased tension on said belt to increase the force between said belt and said stationary retard pad to increase the retard action therebetween; and, means for moving said second roll toward said stack when a non-feed condition is encountered during a sheet feed cycle.

3. A sheet feeding and separating apparatus according to claim 1 wherein said friction means comprises an endless belt rotatably mounted on said first and second rolls, movement of said second roll toward the stack forcing a greater portion of said belt into contact with the stack when a non-feed condition is encountered during a sheet feed cycle.

4. A sheet feeding and separating apparatus according to claim 3 further including a third roll, said third roll being adapted to rotatably support said belt on the side of said first roll opposite said second roll; and, a stationary retard pad mounted on the side of said belt opposite said rolls between said first roll and said third roll, said stationary retard pad causing said belt to be depressed between said first and third rolls, said belt being formed of a substantially non-stretch material;

means mounting said second roll for movement in a direction toward said stack away from said first and third rolls, movement of said second roll toward said stack causing increased tension on said belt to increase the force between said belt and said stationary retard pad to increase the retard action therebetween.

5. A sheet feeding and separating apparatus according to claim 2 further including belt tensioning means to maintain a predetermined tension on said belt;

means mounting said second roll for movement toward said stack, away from said first and third rolls, the length of the belt path around said first, second, and third rolls when said second roll is moved toward said stack being greater than the length of said belt when said belt is under said predetermined tension, movement of said second roll toward the stack thereby causing a tension on said belt in excess of the tension maintained thereon by said tensioning means.

6. A sheet feeding and separating apparatus according to claim 2 further including perforated tray means adapted to support the stack of sheets thereon said sheet feeding and separating belt being mounted adjacent said tray to feed sheets individually from the bottom of the stack; and, means for supplying air under pressure through the perforations in said tray to reduce the frictional force between the bottom sheet of the stack and the tray.

7. A sheet feeding and separating apparatus according to claim 6 wherein said perforated sheet tray includes upstanding sides thereon adapted for engagement with the edges of the sheets in the stack, air escaping from between said tray and the lowest sheet in the stack being forced between said upstanding sides and the edges of the sheets in the stack, a portion of the air passing thereby being forced between adjacent sheets near the bottom of the stack to reduce the friction between the bottom sheet in the stack and the sheet immediately thereabove.

8. A sheet feeding and separating apparatus according to claim 1 further including sheet sensing means disposed downstream from said first feed roll, said sheet sensing means being adapted to activate said means for moving said second roll toward said stack when the absence of a sheet is sensed by said sensing means at a predetermined point in the sheet feed cycle.

* * * * *